US009816263B2

(12) United States Patent
Lee

(10) Patent No.: US 9,816,263 B2
(45) Date of Patent: Nov. 14, 2017

(54) PRE-FABRICATED DOME

(71) Applicant: Yeon Hee Lee, Chungcheongnam-do (KR)

(72) Inventor: Yeon Hee Lee, Chungcheongnam-do (KR)

( * ) Notice: Subject to any disclaimer, the term of this patent is extended or adjusted under 35 U.S.C. 154(b) by 0 days.

(21) Appl. No.: 15/097,651

(22) Filed: Apr. 13, 2016

(65) Prior Publication Data

US 2017/0298613 A1 Oct. 19, 2017

(51) Int. Cl.

| | |
|---|---|
| ***E04B 1/32*** | (2006.01) |
| ***E04B 1/21*** | (2006.01) |
| *E04B 1/00* | (2006.01) |
| *E04B 1/19* | (2006.01) |

(52) U.S. Cl.

CPC ..... *E04B 1/3211* (2013.01); *E04B 1/1906* (2013.01); *E04B 1/21* (2013.01); *E04B 1/1903* (2013.01); *E04B 2001/0061* (2013.01); *E04B 2001/3235* (2013.01); *E04B 2001/3247* (2013.01)

(58) Field of Classification Search

CPC ..... E04B 2001/3294; E04B 2001/3247; E04B 2001/1915; E04B 2001/1918; E04B 2001/1921; E04B 2001/193; E04B 2001/1927; E04B 2001/1957; E04B 2001/1963; E04B 2001/2406; E04B 2001/2415; E04B 1/19; E04B 1/1903; E04B 1/1906; E04B 1/1909; E04B 1/1912; E04B 1/21; E04B 1/215; E04B 1/24; E04B 1/3211; E04B 7/10; E04B 7/102; E04B 7/105; F16B 7/044; A63B 2009/006; E04C 5/0636; E04C 2/40; Y10S 52/10

USPC .. 52/81.1, 81.2, 81.3, 655.1, 655.2, DIG. 10

See application file for complete search history.

(56) References Cited

U.S. PATENT DOCUMENTS

| | | | | |
|---|---|---|---|---|
| 3,854,255 | A * | 12/1974 | Baker | E04B 1/3211 52/81.1 |
| 3,857,212 | A * | 12/1974 | Barnett | E04B 1/3211 403/172 |
| 4,194,851 | A * | 3/1980 | Littlefield | E04B 1/3211 403/218 |

(Continued)

FOREIGN PATENT DOCUMENTS

| | | |
|---|---|---|
| JP | 4-41831 | 2/1992 |
| KR | 10-0397476 | 9/2003 |
| KR | 10-2009-0121994 | 11/2009 |

*Primary Examiner* — Joshua J Michener
*Assistant Examiner* — Matthew Gitlin
(74) *Attorney, Agent, or Firm* — Norris McLaughlin & Marcus, P.A.

(57) ABSTRACT

A pre-fabricated dome and a spherical structure include strut assembly sets, into which glass panels or synthetic resin transparent plates are to be inserted, are assembled into 5 sets of hexagonal modular assemblies around a pentagonal assembly to build a primary pentagonal modular assembly, and further 5 sets of primary pentagonal modular assemblies, into which upper and lower, (outer and inner) struts are assembled in 2 layers (of outer and inner walls), are interconnected to build a semi-spherical dome, and if 12 sets of primary pentagonal modular assemblies are assembled, a solid cylindrical structure can be built to provide a perfect block between the outdoor and the indoor so that the room temperature will not be affected at all by the outdoor temperature.

8 Claims, 14 Drawing Sheets

(56) References Cited

U.S. PATENT DOCUMENTS 4,230,255 A * 10/1980 Coulter ..... E04B 1/3211 228/184
4,680,901 A * 7/1987 Armitage ..... E04B 1/3211 52/81.4
4,703,594 A * 11/1987 Reber ..... E04B 1/3211 403/172
4,729,197 A * 3/1988 Miller ..... E04B 1/3211 403/172
4,736,551 A * 4/1988 Higson ..... E04B 1/3211 403/171
5,406,757 A * 4/1995 Fleishman ..... A45B 23/00 135/15.1
5,560,151 A * 10/1996 Roberts ..... E04B 1/3205 52/245
5,765,326 A * 6/1998 Schuster ..... E04B 1/3211 52/236.2
5,996,288 A * 12/1999 Aiken ..... E04B 1/3211 403/171
6,032,430 A * 3/2000 Soukup ..... E04B 1/585 403/170
6,192,634 B1 * 2/2001 Lopez ..... E04B 1/32 52/639
6,701,691 B1 * 3/2004 Niiduma ..... E04B 1/3211 52/745.2
7,228,671 B1 * 6/2007 McCarten ..... E04B 1/3211 52/125.6
7,770,338 B2 * 8/2010 Nefzi ..... B29C 70/70 52/648.1
7,992,350 B2 * 8/2011 Vriens ..... E04B 1/3211 52/40
8,082,938 B2 * 12/2011 Prusmack ..... E04B 1/32 135/122
8,683,954 B2 * 4/2014 Page ..... A01K 61/007 119/215
8,998,023 B2 * 4/2015 Niemi ..... B23K 31/02 220/560.09
2007/0039254 A1 * 2/2007 Onda ..... B63B 35/44 52/81.1
2013/0152486 A1 6/2013 Hava
2014/0299065 A1 * 10/2014 Cartwright ..... A01K 61/007 119/223

* cited by examiner

PRE-FABRICATED DOME

BACKGROUND OF THE INVENTION

The present invention relates to a pre-fabricated dome and a spherical structure.

Generally, dome-types of housings, residential units, buildings and the like are built by assembled modular components in a simplified way for temporary uses, and dome-types of pre-fabricated housings, buildings and the like, which are used as a large building or a permanent housing to provide a perfect block between room temperature and outdoor temperature, have never been built yet.

Conventional dome-types of structures, which are publicly known, are officially published. Among them, the typical one is UNIVERSAL HUB STRUT SYSTEM FOR A GEODESIC ENCLOUSURE disclosed in US patent no. US 2013/0152486, wherein the geodesic structure is assembled by interconnecting a plurality of universal hubs and struts at each vertex of a geodesic spatial framework. To connect a strut to a universal hub of the present system, a strut-tab on a strut end overlaps a hub-tab of the universal hub, which is secured together via a fastening means through the respective ports. The universal hub with hub-tabs resembles a "flower with petals," the petals corresponding to the hub-tabs and the pistil corresponding to the polygonal center component.

Another dome-type of structure, which is publicly known, is the light-weight dome connector disclosed in Japanese patent publication no. Pyeong4-41831, wherein each hub is inserted into upper and lower ends of a pipe member used as a strut, and the upper and lower hubs have 5-6 pairs of arms protruded radially, and plate struts are inserted between each pair of arms and fixedly attached by bolts and nuts to support the dome in dual layers.

In addition, "dome building" disclosed in Korean patent no. 2009-0121994 is publicly known, wherein the disclosed technology relates to a dome building, comprising side walls with which the dome is polygonally enclosed along circumference of a given area, a pre-fabricated dome roof frame to be installed over the side walls, wherein the dome roof frame is cut off in a given unit length, and both ends of the cut frame have each insertion tab provided in a tetragonal tube form, a plural number of frame pipes going through openings formed at each insertion tab to fasten them, a pair of upper and lower connection openings to receive insertion tabs, which meet at a connection point of each frame pipe when the plural frame pipes are radially arranged around one connection point where they get to meet, and thereby connect them integrally, and a fastening means to fasten and fix each pair of connection openings integrally so that each insertion tab of the plural frame pipes may not come out of the connection openings.

Meanwhile, "pre-fabricated dome house" disclosed in Korean patent no. 10-0397476 is publicly known, wherein the dome house can be built by assembling modular members continuously, of which neighboring faces are continuously interconnected, and each modular member comprises a metal frame having a connection tab with a coupling hole at the end of each side, which is formed by bending it, and urethane resin to be formed by foaming so that the connection tab of the metal frame may be exposed.

SUMMARY OF THE INVENTION

Firstly, the present invention has a different method to build a pre-fabricated dome from the prior method to connect 5-6 struts to the universal hub with 5-6 holes around a central hole, resembling a flower with petals by tightening them with bolts.

Secondly, the present invention is to solve a problem involved with the prior art that each hub is inserted into upper and lower ends of a pipe member used as a strut, and the upper and lower hubs have 5-6 pairs of arms protruded radially, and plate struts are inserted between each pair of arms and fixedly attached by bolts and nuts to support the dome in dual layers.

Thirdly, the present invention is to solve problems involved with the prior art that a plural number of frame pipes going through openings formed at each insertion tab to fasten them are provided, and a pair of upper and lower connection openings to receive insertion tabs, which meet at a connection point of each frame pipe when the plural frame pipes are radially arranged around one connection point where they get to meet, are provided so that each insertion tab of the plural frame pipes may not come out of the connection openings, and that struts are assembled in a single layer, not 2 layers of outer and inner layers in which upper struts and lower struts are inserted into holes provided pentagonally and radially at pipe-form ends of the hub.

The present invention has been created to solve the said problems and shortcomings involved with prior arts by adopting the upgraded technology that strut assembly sets, into which transparent panels (glass panels or synthetic resin transparent plates) are to be inserted, are assembled into 5 sets of hexagonal modular assemblies around a pentagonal modular assembly to build a primary pentagonal modular assembly, and further 5 primary pentagonal modular assemblies, into which upper and lower, and outer and inner struts are assembled in 2 layers of outer and inner walls of the dome building, are interconnected to build a semi-spherical dome, wherein pentagonal and hexagonal modular assemblies are assembled with bolts and nuts, and transparent panels are vacuum-assembled so that outdoor air may not communicate with indoor air by giving some inclination toward inner walls (internal direction) respectively, and thereby modular assemblies for a semi-spherical pre-fabricated dome house are formed to build a completely assembled dome.

When modular assemblies are assembled to provide one pentagonal assembly hub in the center and 5 hexagonal assembly hubs, a pentagonal modular assembly gets to be formed. 6 sets of such pentagonal modular assemblies are interconnected and assembled into a semi-spherical dome house. A complete spherical building can be also built. In case that 6 sets of modular assemblies suitable for a building structure are pre-fabricated at a factory and they are only assembled on site, the work period and the work cost get to be shortened and reduced and further a semi-spherical pre-fabricated dome house, which has various advantages of solid section performance, strong fire-resistance, high durability, strong corrosion-resistance and strong earthquake-resistance, is provided. If 12 sets of pentagonal modular assemblies are assembled, a cylindrical structure can be built.

The present invention is characterized by provision of a semi-spherical dome house, a complete spherical building and further a cylindrical structure, wherein strut assembly sets, into which glass panels or synthetic resin transparent plates are to be inserted, are assembled into 5 sets of hexagonal modular assemblies around a pentagonal modular assembly to build a primary pentagonal modular assembly, and further 5 sets of primary pentagonal modular assemblies, into which upper and lower (outer and inner) struts are assembled in 2 layers, are interconnected to build a semi-spherical dome to provide a perfect block between the outdoor and the indoor so that the room temperature will not be affected at all by the outdoor temperature. In case that modular assemblies suitable for a building structure are pre-fabricated at a factory and they are only assembled on site, the work period and the work cost get to be shortened and reduced and further a semi-spherical pre-fabricated dome house, which has various advantages of solid section performance, strong fire-resistance, high durability, strong corrosion-resistance and strong earthquake-resistance, is provided.

Figure 1:
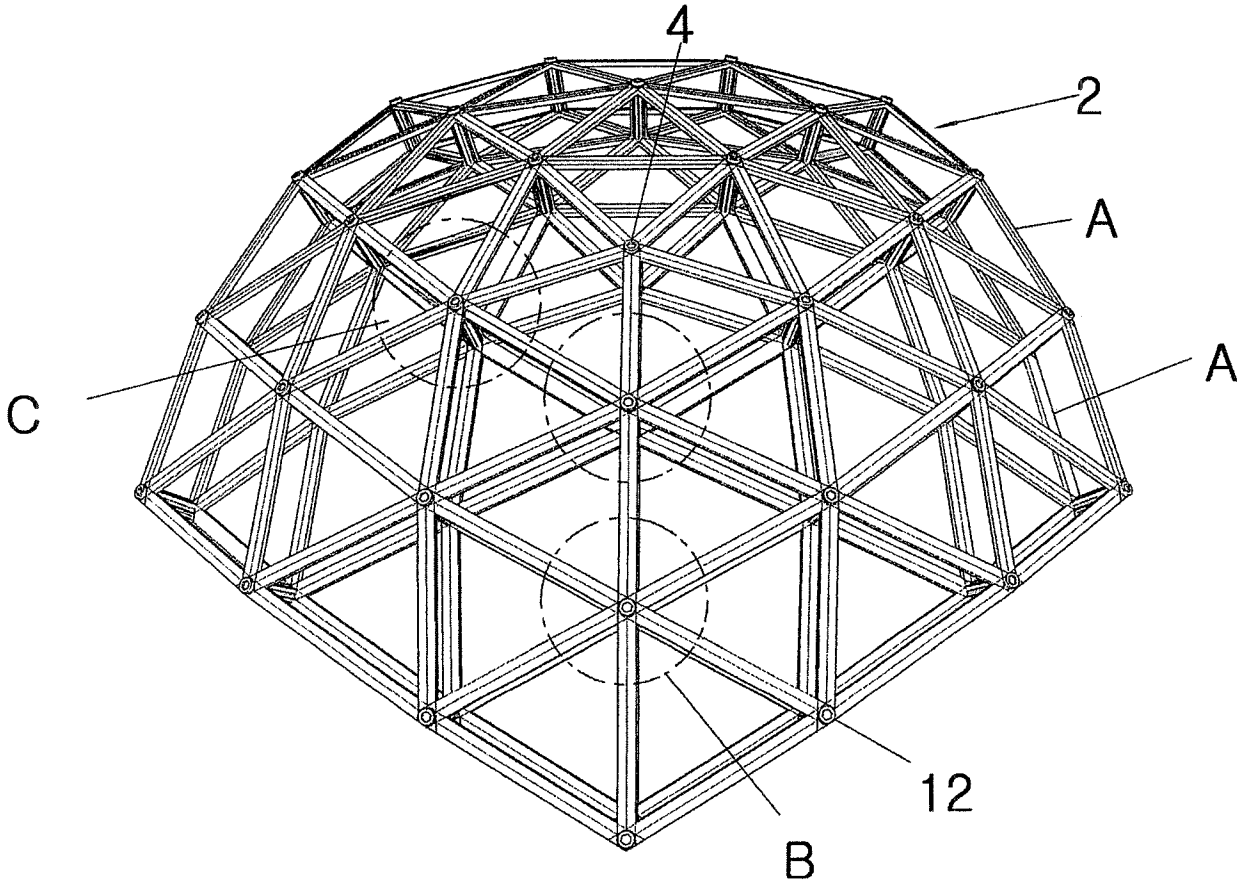
FIG. 1 is a perspective view illustrating a set of primary pentagonal modular assemblies to build the pre-fabricated dome and the spherical structure according to the present invention.

Description of Reference Designations of Main Parts of Drawings

| | |
|---|---|
| A: strut assembly set | B: hexagonal assembly hub |
| C: pentagonal assembly hub | D: cylindrical structure |
| K: strut surface length | K': strut inner surface length |
| 1: completely assembled dome (built by assembling 6 sets of pentagonal modular assemblies (2)) | |
| 2: pentagonal modular assembly | 3: Dome Support |
| 3': Gate | 4: pentagonal assembly panel |
| 5: outer strut | 5', 5": packing insertion mount |
| 5a, 5b: outer packing | 5c: central prop plate |
| 5d: bevel | 5e: formed groove |
| 6: inner strut | 6', 6": packing insertion mount |
| 6a, 6b: inner packing | 6c: formed groove |
| 6d: bevel | 7: transversal beam |
| 7': bolt opening | 7": inner prop plate |

-continued

| Description of Reference Designations of Main Parts of Drawings | |
|---|---|
| 7a: bump insertion port | 8: transversal bolt (with its head opening) |
| 8': head opening | 8": bolt bump |
| 9: fixing bolt (to be inserted through the head of the transversal bolt to tighten the strut assembly) | |
| 9': bolt for fixing the upper cover | 9": bolt for fixing the lower cover |
| 9a: bolt with a head ring | 10: axial pillar with 7 bolt openings |
| 10a: axial pillar with 5 bolt openings (for assembling 4 struts in the X shape) | |
| 10b: axial pillar with 5 bolt openings (for assembling 4 struts in the + form) | |
| 10': bolt opening of axial pillar | 10": bolt bump insertion port |
| 11, 11': glass (transparent panel) | |
| 12, 12': upper/lower cover plates for upper/lower fastening parts of the axial pillar | |
| 12a: cover plate packing | 13, 13': packing |
| 14, 14': bolt opening | 15, 15': bolt bump insertion port |
| 16, 16': dark black line of linking ring | |
| 17: arc line | |
| 18: horizontal line (linking line between a pentagon and a hexagon) | |
| 19: support tube for a spherical structure | |
| 20: spherical structure | |

DETAILED DESCRIPTION OF THE INVENTION

Embodiments are described as follows by reference to the attached drawings.

Figure 2:
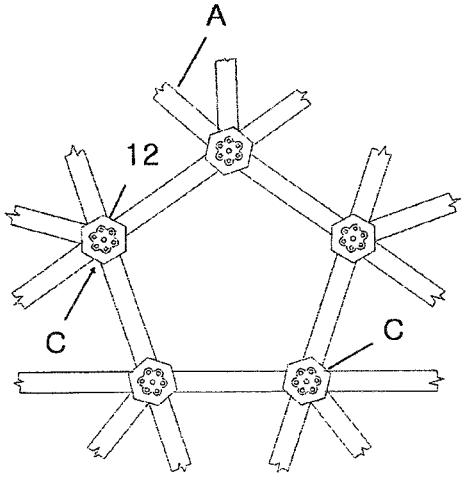
FIG. 2 is a view illustrating one embodiment of the pre-assembly arrangement centering on the primary pentagonal modular assembly to build the pre-fabricated dome and the spherical structure according to the present invention.

FIG. 1 is a perspective view illustrating a set of primary pentagonal modular assemblies to build the pre-fabricated dome and the spherical structure according to the present invention. FIG. 2 is a view illustrating one embodiment of the pre-assembly arrangement centering on the primary pentagonal modular assembly to build the pre-fabricated dome and the spherical structure according to the present invention.

Figure 3:
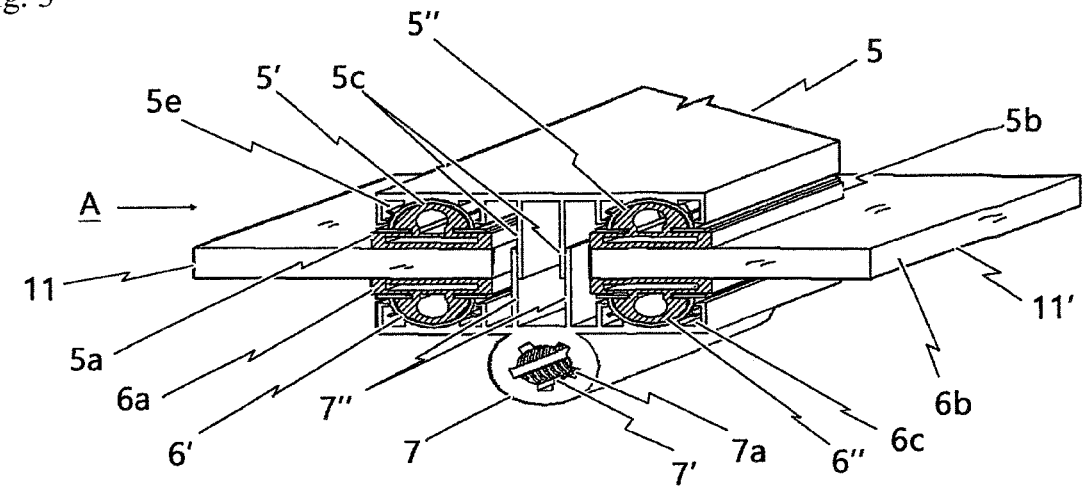
FIG. 3 is a detailed perspective view (the rear longitudinal part not shown) illustrating the assembled strut set in the pre-fabricated dome and the spherical structure according to the present invention.
Figure 4:
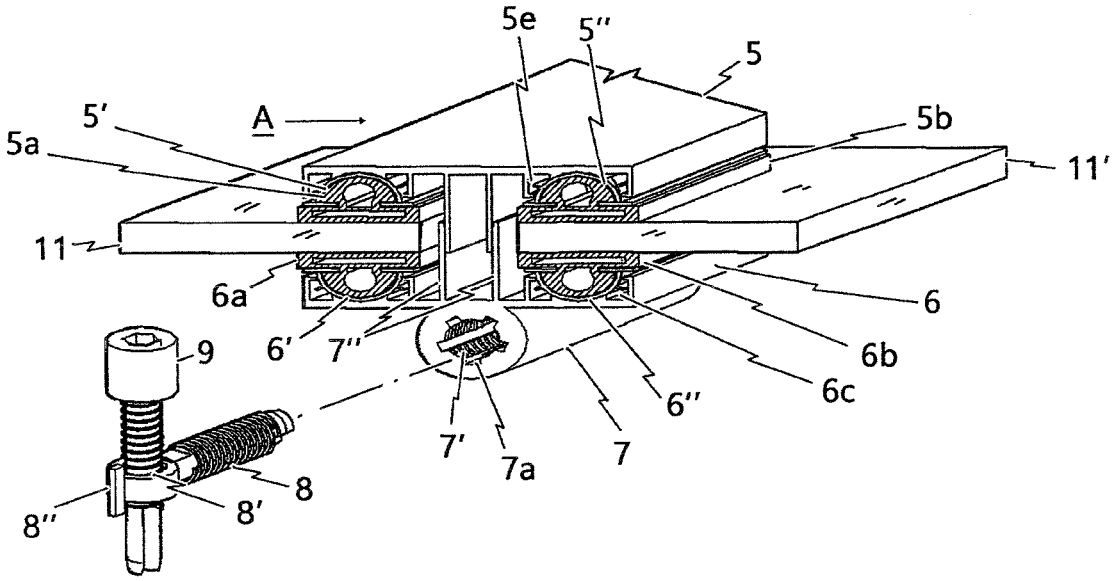
FIG. 4 is a view illustrating the enlarged state of the strut set assembled with a transversal bolt and a vertical fixing bolt in the pre-fabricated dome and the spherical structure according to the present invention.
Figure 5:
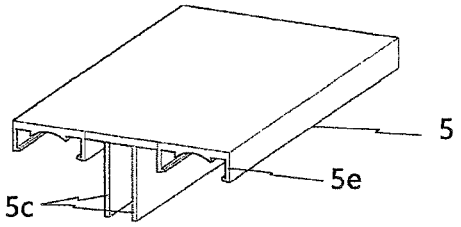
FIG. 5, FIG. 6, FIG. 7 and FIG. 8 are exploded views illustrating outer and inner struts in the pre-fabricated dome and the spherical structure according to the present invention, and sectional views illustrating a packing insertion mount and a packing.

FIG. 3 is a detailed perspective view (the rear longitudinal part not shown) illustrating the assembled strut set in the pre-fabricated dome and the spherical structure according to the present invention. FIG. 4 is a view illustrating the enlarged state of the strut set assembled with a transversal bolt and a vertical fixing bolt in the pre-fabricated dome and the spherical structure according to the present invention. FIG. 5, FIG. 6, FIG. 7 and FIG. 8 are exploded views illustrating outer and inner struts in the pre-fabricated dome and the spherical structure according to the present invention, and sectional views illustrating a packing insertion mount and a packing.

Figure 9:
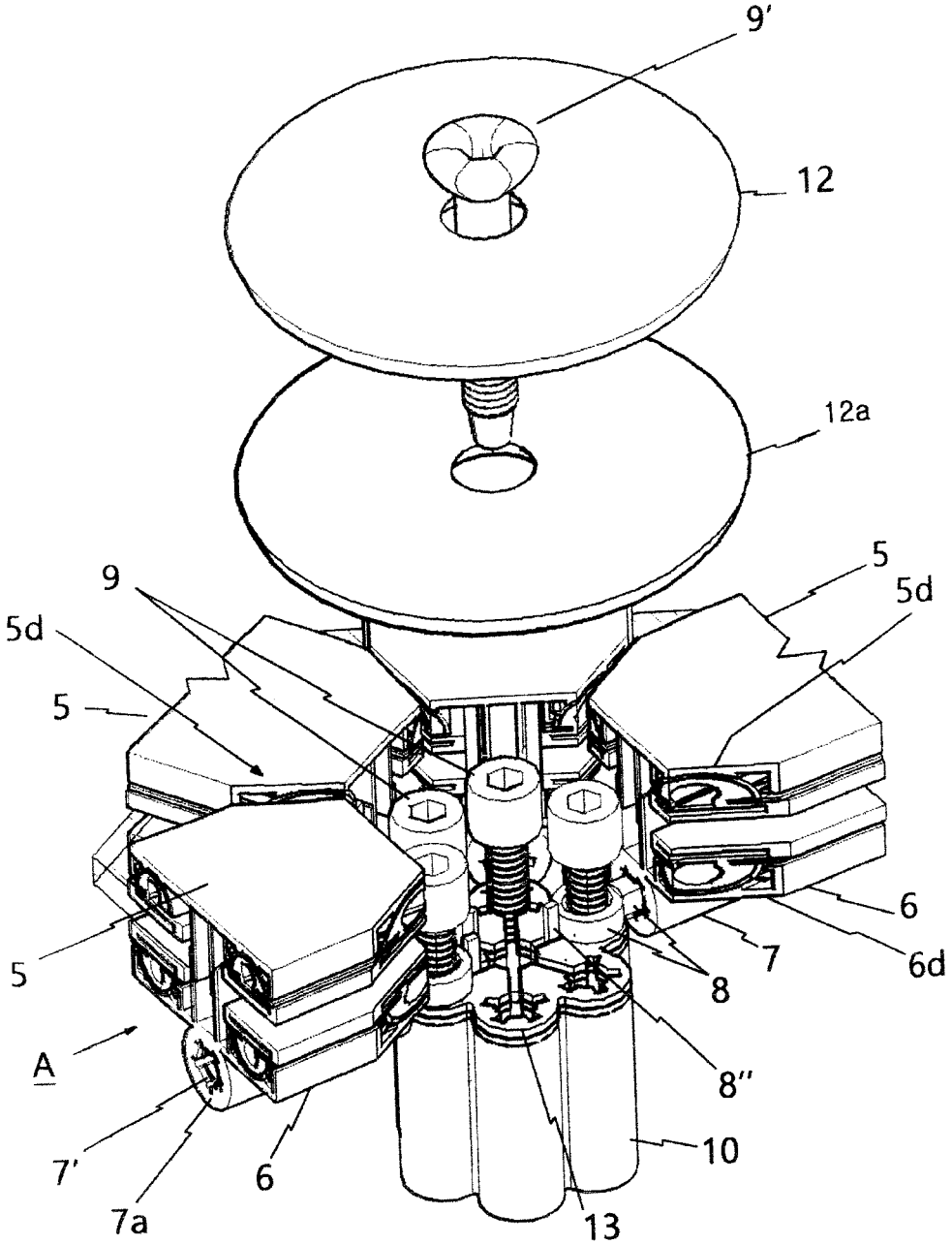
FIG. 9 is an exploded and enlarged view illustrating Part C in the pre-fabricated dome and the spherical structure according to the present invention, the assembled upper and outer struts to be securely attached to each bolt opening of the axial pillar with each transversal bolt and fixing bolt (inner struts are to be assembled in the same manner to the opposite lower end of the axial pillar), and the partial hexagonal assembly which is equivalent to 4 struts to remain after 2 struts are excluded from the hexagonal assembly shown in the sectional view of FIG. 12.
Figure 12:
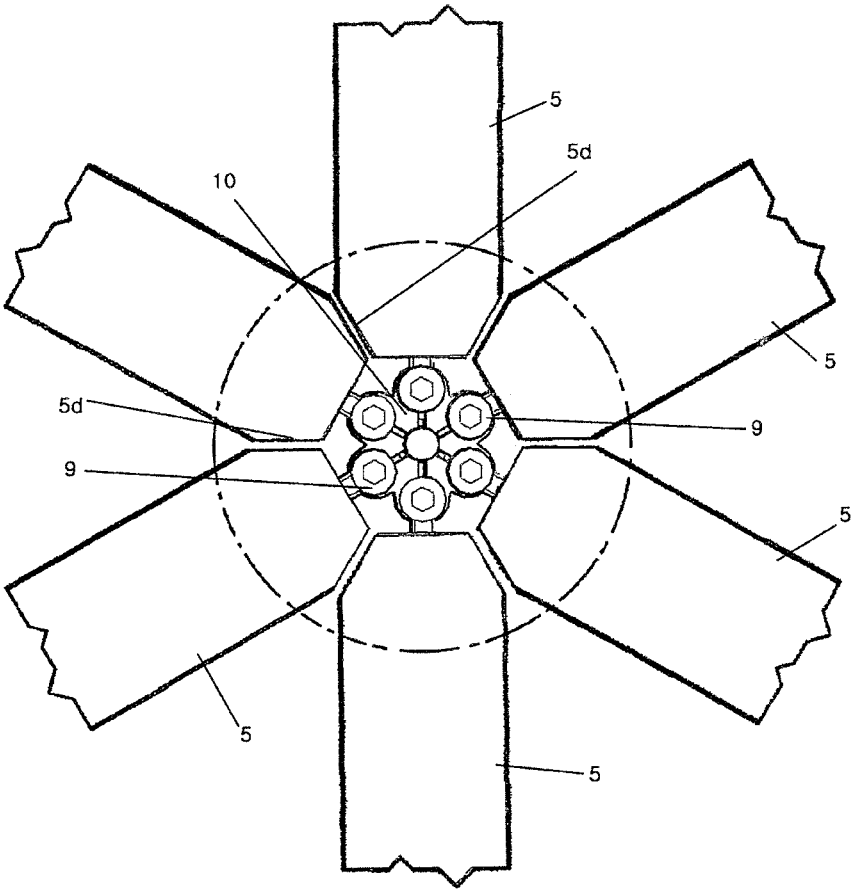
FIG. 12 is an enlarged plan illustrating Part B in the pre-fabricated dome and the spherical structure according to the present invention, where 6 struts are coupled with the hexagonal hub with 6 bolt openings into which each transversal bolt is tightened to adjust the gap between each strut and the hub, and then each fixing bolt is made to go through the head of each transversal bolt and it is tightened into each bolt opening to fix the strut with the cover panel not assembled.

FIG. 9 is an exploded and enlarged view illustrating Part C in the pre-fabricated dome and the spherical structure according to the present invention, the assembled upper and outer struts to be securely attached to each bolt opening of the axial pillar with each transversal bolt and fixing bolt (inner struts are to be assembled in the same manner to the opposite lower end of the axial pillar), and the partial hexagonal assembly which is equivalent to 4 struts to remain after 2 struts are excluded from the hexagonal assembly shown in the sectional view of FIG. 12.

Figure 10:
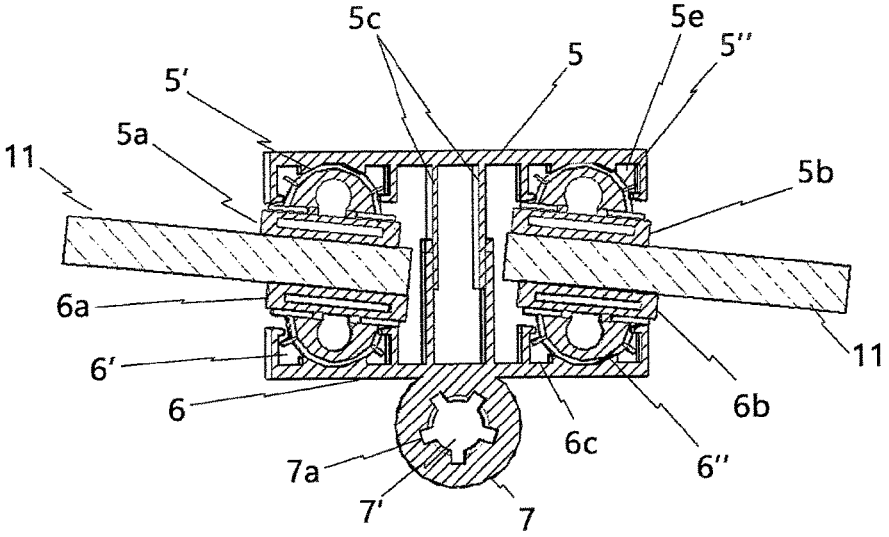
FIG. 10 is a front view of the strut assembly set illustrating the state that the glass panel is inclined to the right in the pre-fabricated dome and the spherical structure as assembled according to the present invention.
Figure 11:
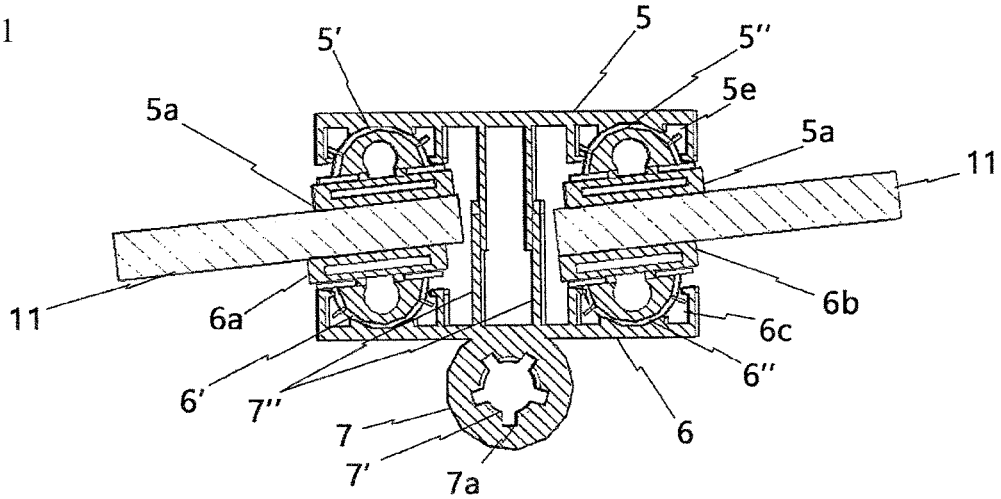
FIG. 11 is a front view of the strut assembly set illustrating the state that the glass panel is inclined to the left due to the curved surface pivot on which the glass panel hold the packing by inserting the glass panel into both ends shown in FIG. 10 and the curved surface inside the strut to support the curved surface pivot in the pre-fabricated dome and the spherical structure according to the present invention.

FIG. 10 is a front view of the strut assembly set illustrating the state that the glass panel is inclined to the right in the pre-fabricated dome and the spherical structure as assembled according to the present invention. FIG. 11 is a front view of the strut assembly set illustrating the state that the glass panel is inclined to the left due to the curved surface pivot on which the glass panel hold the packing by inserting the glass panel into both ends shown in FIG. 10 and the curved surface inside the strut to support the curved surface pivot in the pre-fabricated dome and the spherical structure according to the present invention.

Figure 13:
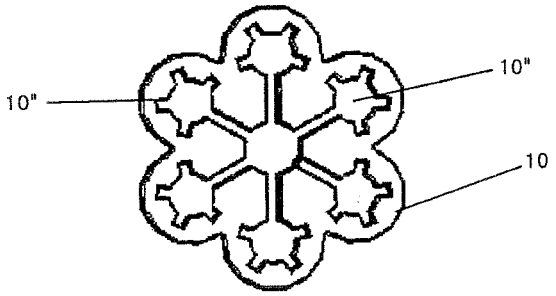
FIG. 13 is a plan of the axial pillar with 7 bolt openings in the pre-fabricated dome and the spherical structure according to the present invention.

FIG. 12 is an enlarged plan illustrating Part B in the pre-fabricated dome and the spherical structure according to the present invention, where 6 struts are coupled with the hexagonal hub with 6 bolt openings into which each transversal bolt is tightened to adjust the gap between each strut and the hub, and then each fixing bolt is made to go through the head of each transversal bolt and it is tightened into each bolt opening to fix the strut with the cover panel not assembled. FIG. 13 is a plan of the axial pillar with 7 bolt openings in the pre-fabricated dome and the spherical structure according to the present invention.

Figure 14:
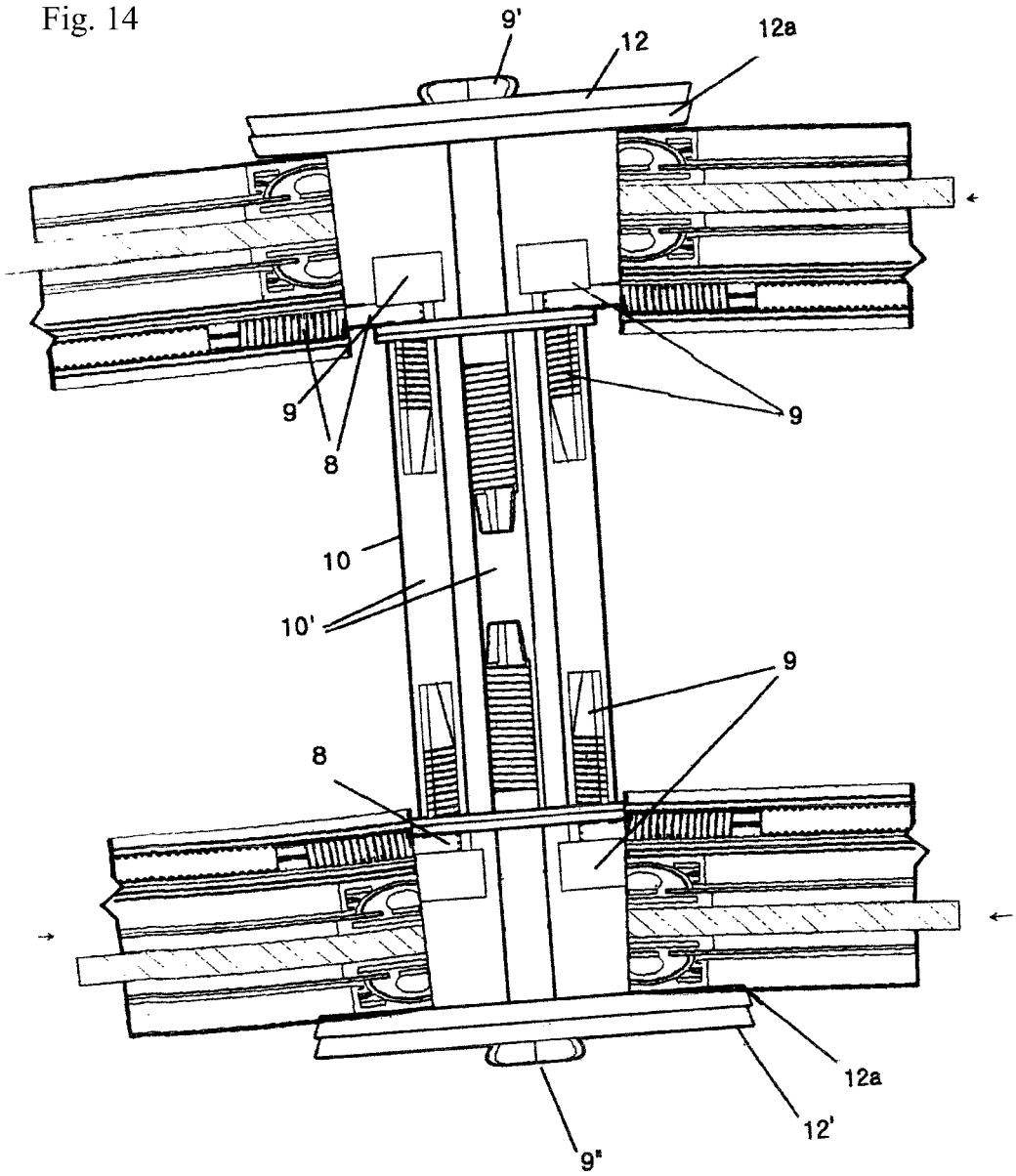
FIG. 14 is an enlarged sectional view of one core part illustrating the state that outer and inner struts are coupled with the bolt openings of the axial pillar in 2 layers by fastening them with transversal bolts and fixing bolts in the pre-fabricated dome and the spherical structure according to the present invention.

FIG. 14 is an enlarged sectional view of one core part illustrating the state that outer and inner struts are coupled with the bolt openings of the axial pillar in 2 layers by fastening them with transversal bolts and fixing bolts in the pre-fabricated dome and the spherical structure according to the present invention.

Figure 15:
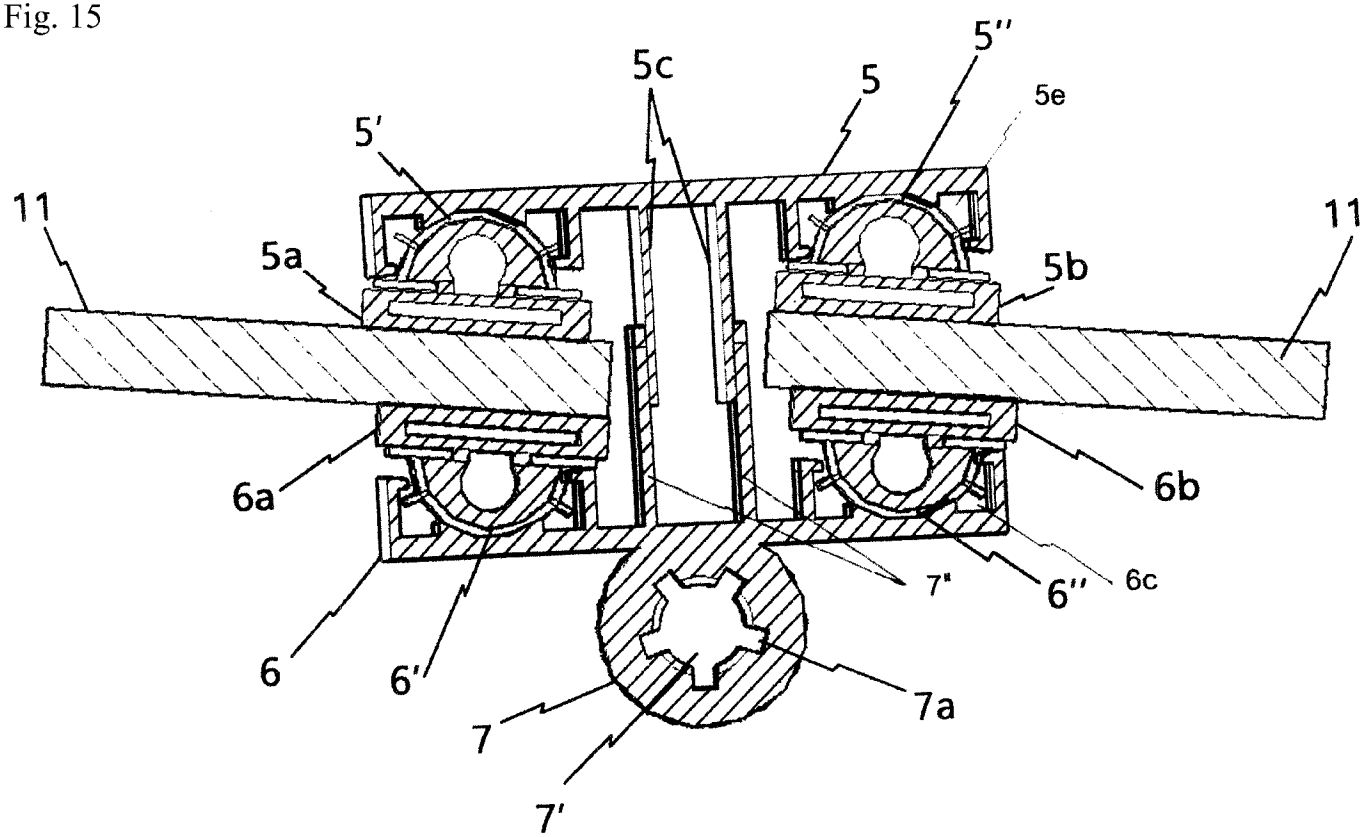
FIG. 15 is an enlarged perspective view illustrating the state that the packing insertion mount and the packing are inserted into the outer strut in the pre-fabricated dome and the spherical structure according to the present invention, as shown in FIG. 10.
Figure 16:
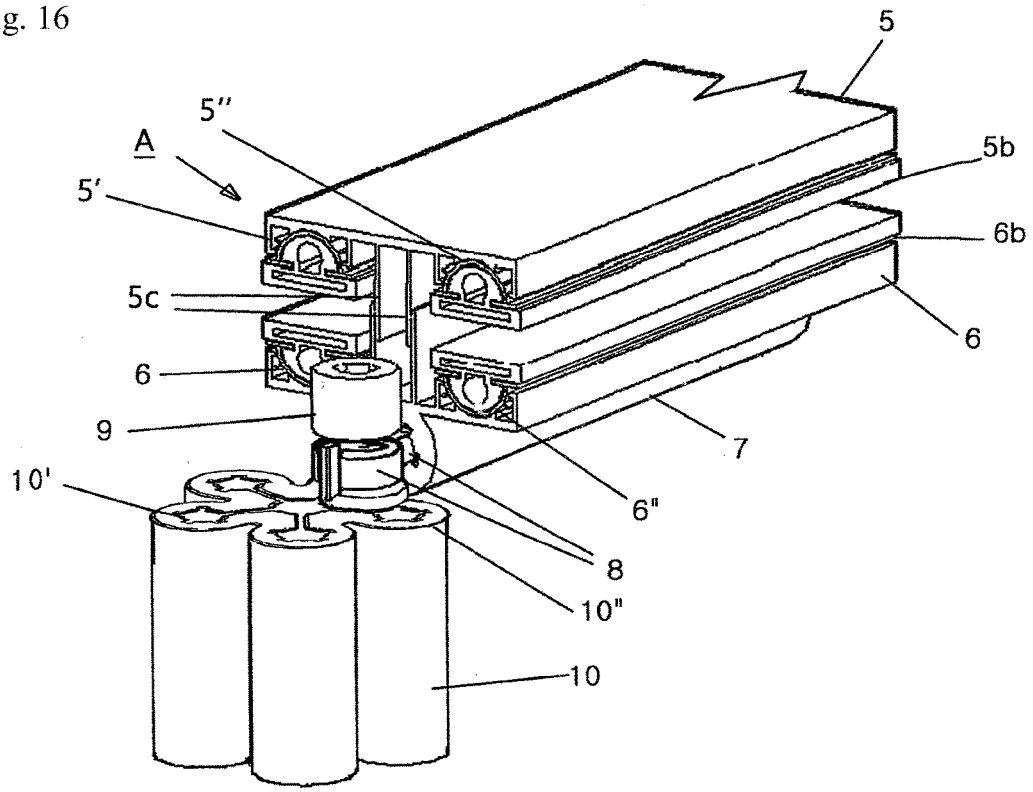
FIG. 16 is a perspective view illustrating the state that the outer and inner strut assembly sets are coupled with 5 bolt openings of the axial pillar by tightening them with bolts in the pre-fabricated dome and the spherical structure according to the present invention.
Figure 17:
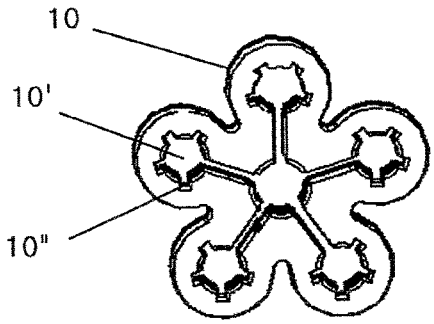
FIG. 17 is a plan of the axial pillar with 5 bolt openings in the pre-fabricated dome and the spherical structure according to the present invention, as shown in FIG. 16.

FIG. 15 is an enlarged perspective view illustrating the state that the packing insertion mount and the packing are inserted into the outer strut in the pre-fabricated dome and the spherical structure according to the present invention, as shown in FIG. 10. FIG. 16 is a perspective view illustrating the state that the outer and inner strut assembly sets are coupled with 5 bolt openings of the axial pillar by tightening them with bolts in the pre-fabricated dome and the spherical structure according to the present invention. FIG. 17 is a plan of the axial pillar with 5 bolt openings in the pre-fabricated dome and the spherical structure according to the present invention.

Figure 18:
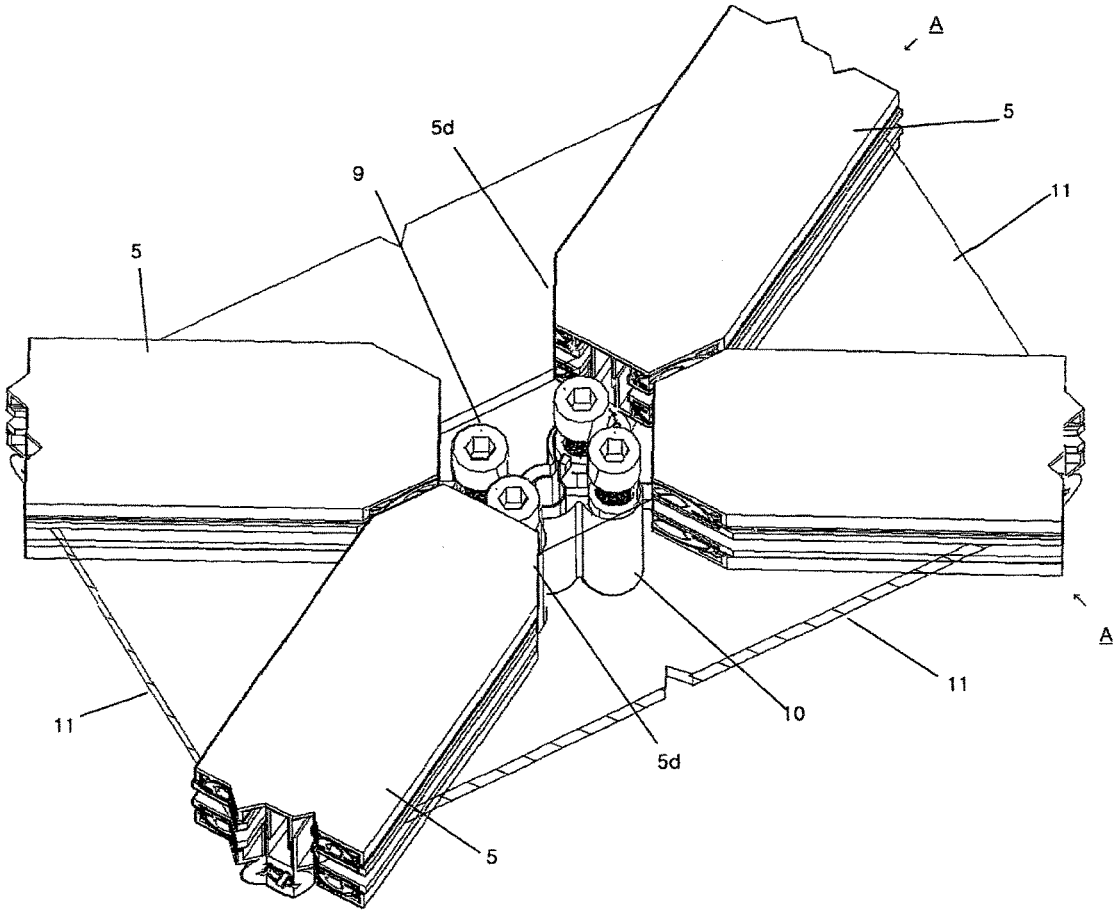
FIG. 18 is an enlarged perspective view illustrating the state that 4 outer strut assembly sets (upper) are coupled with the 4 bolt openings of the axial pillar in the X shape in the pre-fabricated dome and the spherical structure according to the present invention.
Figure 19:
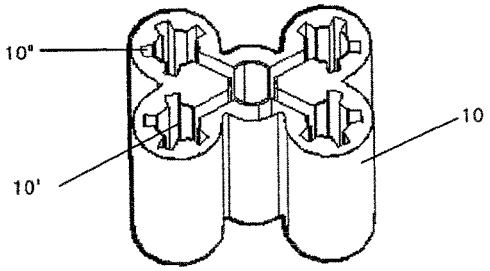
FIG. 19 is a plan of the axial pillar with 5 bolt openings in the pre-fabricated dome and the spherical structure according to the present invention, as shown in the perspective view of the upper axial pillar in FIG. 18.
Figure 20:
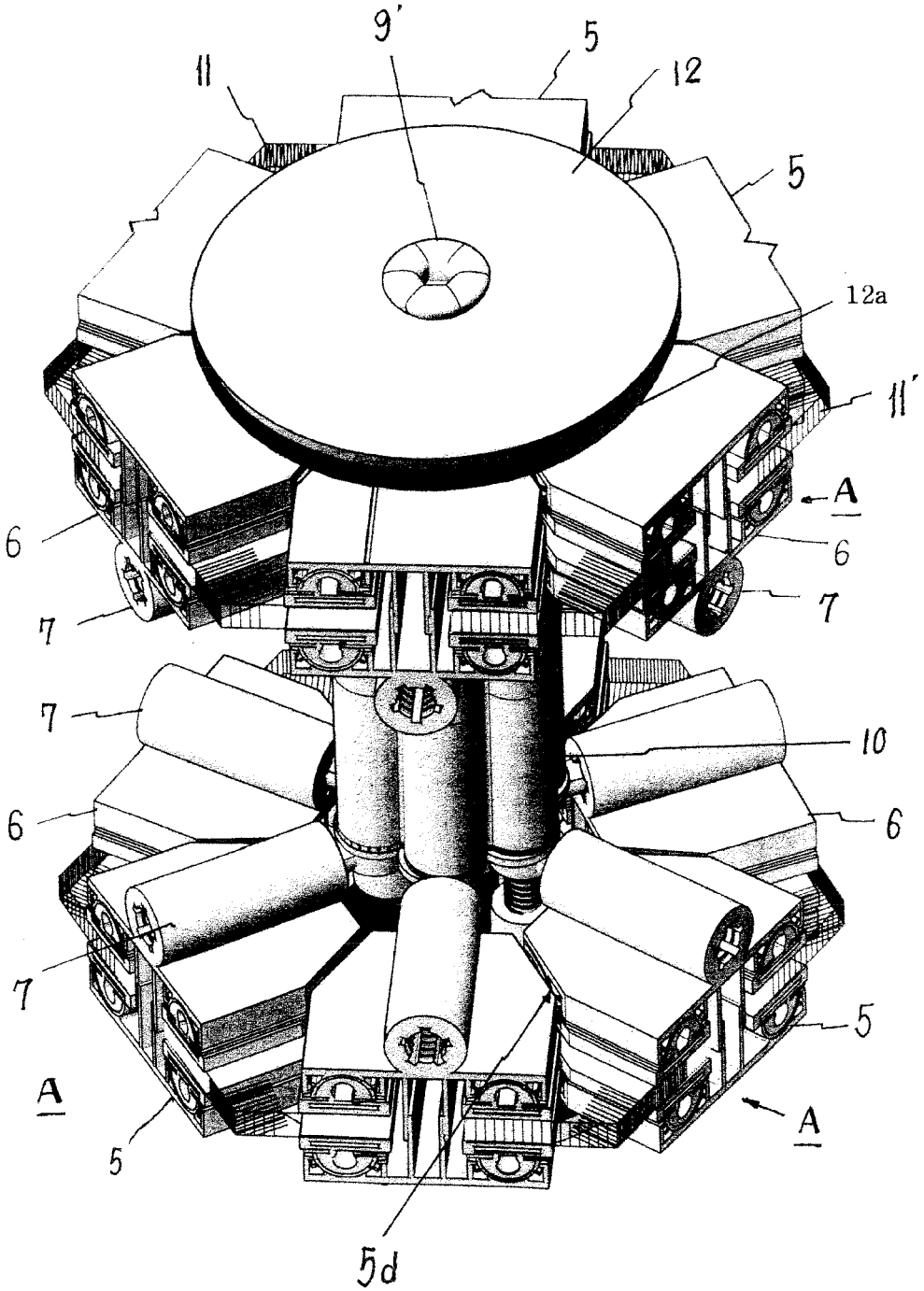
FIG. 20 is an enlarged perspective view of core parts of the assembled hexagonal strut set shown from the top view point and the bottom view point in the pre-fabricated dome and the spherical structure according to the present invention.
Figure 21:
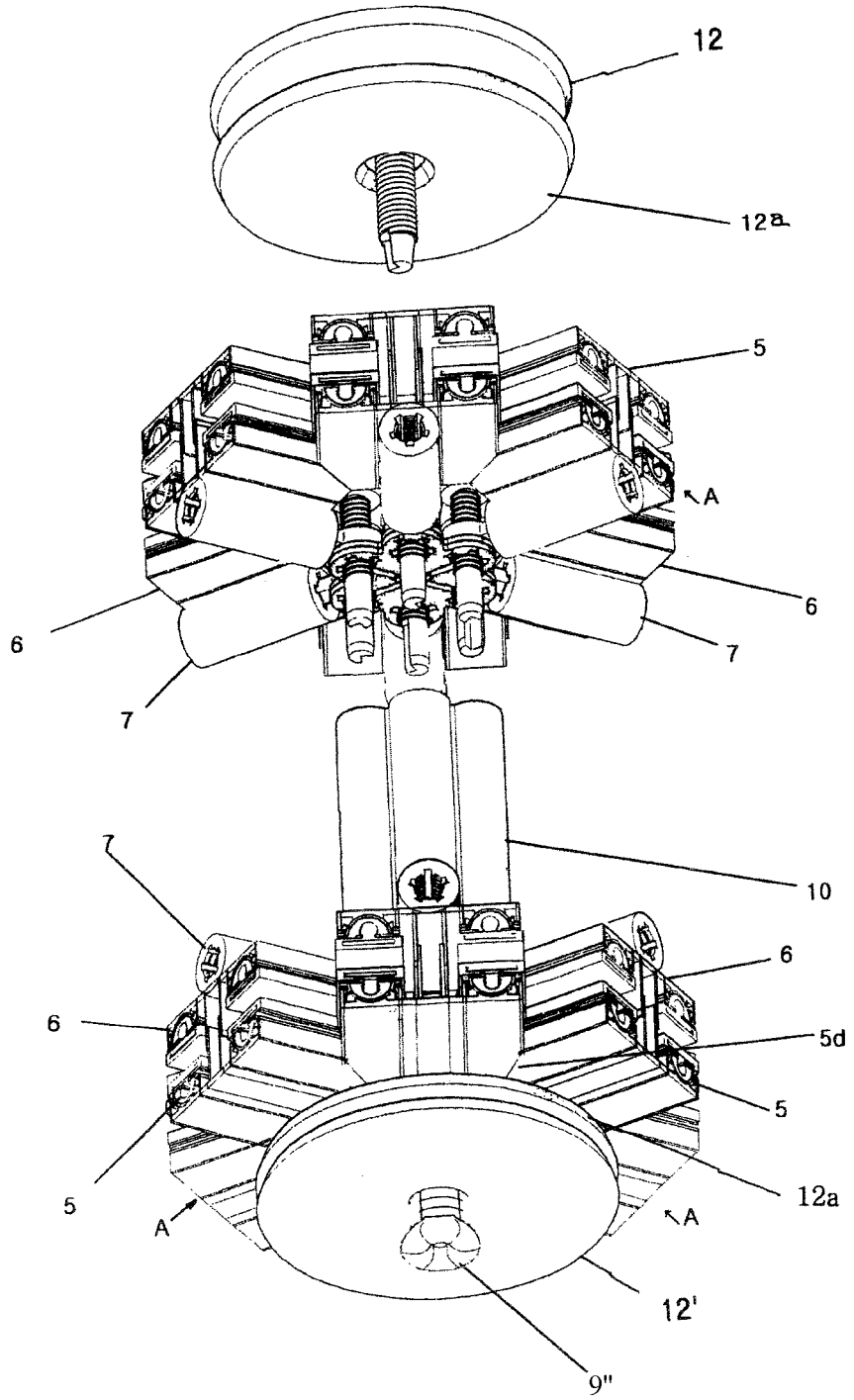
FIG. 21 is an enlarged perspective view of separated core parts of the hexagonal strut assembly set shown from the bottom view point in the pre-fabricated dome and the spherical structure according to the present invention.

FIG. 18 is an enlarged perspective view illustrating the state that 4 outer strut assembly sets (upper) are coupled with the 4 bolt openings of the axial pillar in the X shape in the pre-fabricated dome and the spherical structure according to the present invention. FIG. 19 is a plan of the axial pillar with 5 bolt openings in the pre-fabricated dome and the spherical structure according to the present invention, as shown in the perspective view of the upper axial pillar in FIG. 18. FIG. 20 is an enlarged perspective view of core parts of the assembled hexagonal strut set shown from the top view point and the bottom view point in the pre-fabricated dome and the spherical structure according to the present invention. FIG. 21 is an enlarged perspective view of separated core parts of the hexagonal strut assembly set shown from the bottom view point in the pre-fabricated dome and the spherical structure according to the present invention.

Figure 22:
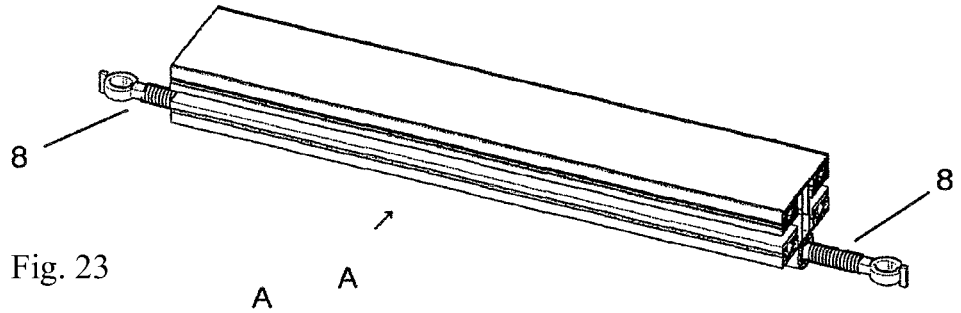
FIG. 22 is a perspective view the state that each transversal bolt (8) is inserted into both ends of the transversal beam (7) of the strut assembly set (A) in the pre-fabricated dome and the spherical structure according to the present invention.
Figure 23:
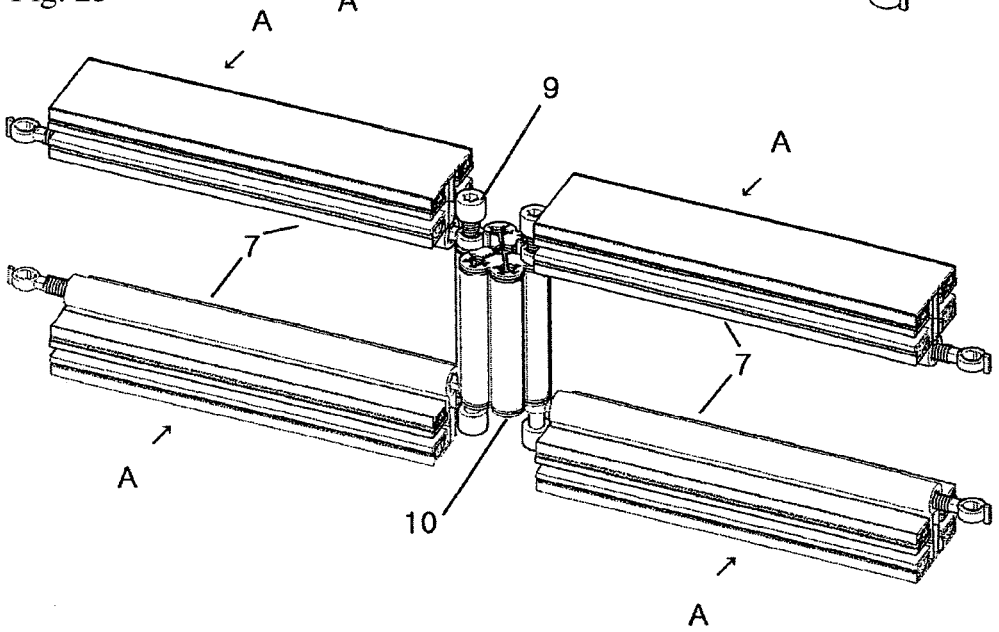
FIG. 23 is an exploded perspective view illustrating the state that strut assembly sets are coupled with the upper and lower ends of the axial pillar (10) in the pre-fabricated dome and the spherical structure according to the present invention.

FIG. 22 is a perspective view the state that each transversal bolt (8) is inserted into both ends of the transversal beam (7) of the strut assembly set (A) in the pre-fabricated dome and the spherical structure according to the present invention. FIG. 23 is an exploded perspective view illustrating the state that strut assembly sets are coupled with the upper and lower ends of the axial pillar (10) in the pre-fabricated dome and the spherical structure according to the present invention.

Around the pentagonal modular assembly (2) shown in FIG. 1 according to the present invention, 5 ea of hexagonal assembly hubs (B) are interconnected and assembled. Means for interconnection and assembly are the hexagonal assembly hub (B) and the pentagonal assembly hub (C), which are structures shown in FIG. 21, as assembled in 2 layers, wherein outer struts (5) and inner struts (6) are assembled to the axial pillar (10), and the upper/lower fastening parts of the axial pillar are covered with the cover plate (12) and the packing (12'), which are fixed with the bolts (9') (9") for fixing the upper/lower cover plates, and thereby the hexagonal assembly hub (B) and the pentagonal assembly (C) are assembled to form one pentagonal modular assembly (2).

When 6 sets of pentagonal modular assemblies (2) are assembled, the semi-spherical dome can be built.

That is to say, the simply formed structure is assembled in 2 layers via the hexagonal assembly hub (B) and the pentagonal assembly hub C.

As with the strut assembly set (A) shown in FIG. 3, FIG. 4, FIG. 9, FIG. 10, FIG. 11, FIG. 14 and FIG. 16, a plural number of bump insertion ports are formed in each bolt openings (10') provided in the axial pillar (10), and each outer strut (5) and each inner strut (6) are coupled with the axial pillar for each connection. Then, the transversal bolt (8) with the head opening is inserted through the bolt opening (7') of the transversal beam (7), and the fixing bolt (9) is inserted through the bolt opening (8') with the bolt bump (8") in the head of the transversal bolt (8). Further, this bolt is inserted and vertically tightened through the bolt opening (10') of the axial pillar (10) to fix the said structure, wherein the bolt bump (8") provided on the circumference of the head bolt opening (8') is inserted into the bump insertion port (7*a*) formed in the bolt opening of the axial pillar to prevent the transversal bolt (8) from wobbling when the fixing bolt (9) is inserted and tightened through the head opening (8') of the transversal bolt (8).

The transparent glass panels (11)(11'), which are inserted between the outer strut (5) and the inner strut (6), particularly between left/right outer packings and left/right inner packings, are shown in a partial length, not full length, for convenience' sake in preparation of drawings.

All of the strut assembly sets (A) are secured into all of the bolt openings (10') of the axial pillar (10) in the said manner. As shown in FIG. 12, 6 strut assembly sets are assembled and fixed to form the hexagonal assembly hub (B). Meanwhile, as shown in FIG. 2, FIG. 16 and FIG. 17 (axial pillar with 5 openings), 5 strut assembly sets are assembled and fixed to form the pentagonal assembly hub (C).

Each strut assembly set (A), which is shown in FIG. 3, FIG. 4, FIG. 12, FIG. 15 and FIG. 16, can have bevels (5*d*) (6*d*) formed on both edges of each of outer/inner struts so that it may be easily connected with the upper end of the axial pillar (10), or it can have one bevel formed on either edge of each of outer/inner struts or a straight line of the connection surface of each of outer/inner struts.

The hexagonal assembly hub (B) and the pentagonal assembly hub C, which are simply formed and assembled in 2 layers to build the semi-spherical dome according to the present invention, have no difference in the assembly process thereof.

The hexagonal assembly hub (B) and the pentagonal assembly hub C, which are simply formed and assembled in 2 layers to build the semi-spherical dome according to the present invention, are components to form the pentagonal modular assembly (2) as shown in FIG. 1.

Figure 6:
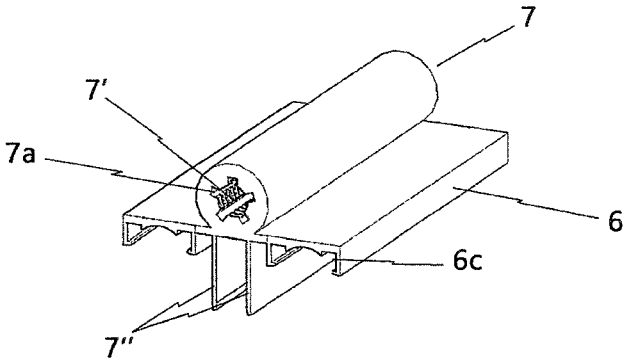
Figure 7:
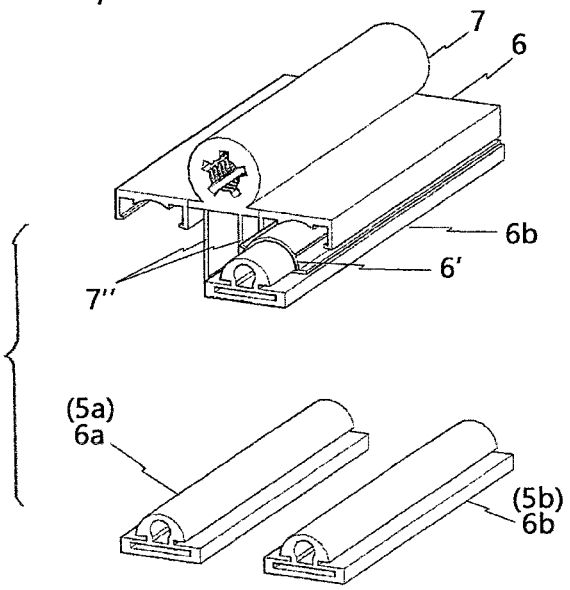
Figure 8:
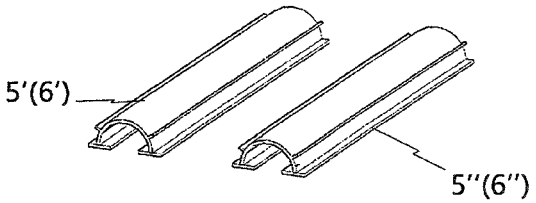

As illustrated in FIG. 5 to FIG. 8, the outer strut (5) is coupled with the inner strut (6), which is shown in FIG. 6 and FIG. 7, by inserting its central prop plate (5*c*) into the prop plate (7") of the inner strut, and each packing insertion mount (5')(5")(6')(6") is inserted into each groove (5*e*) (6*c*), and each outer/inner packing (5*a*)(5*b*)/(6*a*)(6*b*) is inserted into each packing insertion mount. By this assembly process, the strut assembly set (A) gets to be formed.

In the strut assembly set (A), the prop plate (5*c*) is protruded under the mid part of the outer strut (5), and the groove (5*e*), into which the packing insertion mount (5')(5") is to be inserted, is formed on both sides, and the packing insertion mount (5')(5"), into which the outer packing (5*a*) (5*b*) is inserted, is inserted into both grooves (5*e*), and thereby the upper outer strut (5) is formed; and lower/inner struts (6), which are to be coupled with upper/outer struts, have also a pair of inner prop plates (7"), each of which receives the prop plate (5*c*), protruded upward on the mid part thereof, and the transversal beam (7), which has a plural number of bump insertion ports (7*a*) formed by providing bolt openings (7'), is integrally formed under each strut, and the groove (6*c*), into which the packing insertion mount (6')(6") is inserted, is formed on both sides, and the packing insertion mount (6')(6"), into which the inner packing (6*a*)(6*b*) is inserted, is inserted into the groove (6*c*) and thereby the strut assembly set is assembled.

When the prop plate (5*c*) of the outer strut (5) is inserted and assembled between the inner prop plates (7") protruded on the inner strut (6), and transparent or glass panels (11)(11') are inserted and installed between outer/inner packings (5*a*)(5*b*)(6*a*)(6*b*), the curved surface, which is holding the outer packings (5*a*)(5*b*) and the inner packings (6*a*)(6*b*), supports the curved surface pivot so that it may adjust the angle of each glass panel (11)(11'). Each transparent glass panel (11)(11'), which is inserted between outer/inner packings (5*a*)(5*b*)(6*a*)(6*b*), can be wobbled to adjust the angle to the right or the left B, as shown in FIG. 10, FIG. 11 and FIG. 15, by the elastic force on the curved surface pivot, and further blocks any inflow of air or water through any gap. Actually, both glass plates (11)(11') can be adjusted downward at 30° by the elastic force of the packing, which is required to assemble and form the semi-spherical or complete spherical dome.

When the strut assembly set (A) is assembled, the transversal bolt (8) with the head bolt opening (8') having the bolt bump (8"), as shown in FIG. 3, FIG. 4, FIG. 10, FIG. 11, FIG. 15 and FIG. 16, is inserted and tightened into the bolt opening (7') of the transversal beam and thereby the bolt bump (8") gets to be inserted into the blot bump insertion port (10") formed in the bolt opening (10') of the axial pillar (10). And the fixing bolt (9) is inserted and tightened into the bolt opening (10') of the axial pillar (10), which is vertically aligned with the head bolt opening (8') of the transversal bolt (8), to fix them. As the transversal bolt (8) is inserted and tightened deeply or shallowly into the bolt opening (7') of the transversal beam (7), the gap between the outer strut (5) and the inner strut (6) can be adjusted according to it.

Each strut assembly set (A) is assembled to 5 or 6 bolt openings (10') of the axial pillar (10) in the same manner, as shown in FIG. 9 and FIG. 12. As illustrated in FIG. 14, upper/lower strut assembly sets (A) are oppositely fastened and assembled to the axial pillar (10), and then upper/lower cover plates (12)(12') for upper/lower fastening parts of the axial pillar are fixed onto upper/lower ends of the axial pillar (10) by inserting and tightening upper/lower fixing bolts (9')(9") into the central bolt opening of the axial pillar (10). Thereby each pentagonal or hexagonal assembly hub is completely assembled. Upper/lower cover plates (12)(12') for upper/lower fastening parts of the axial pillar has the packing (12*a*) attached to itself to have the water-proof effect.

If each pentagonal or hexagonal assembly hub is continuously interconnected, 5 hexagonal assembly hubs are combined around the pentagonal assembly hub (4) assembled in 2 layers, including pentagonal and hexagonal forms, as shown in FIG. 1, to form the pentagonal modular assembly (2).

5 pentagonal modular assemblies, as shown in FIG. 1.

Particularly, if the length of the outer strut (5) is 10 cm, the length of the inner strut (6) should be 9 cm, shorter than that of the outer strut. Such shorter length of the inner strut is to address the tolerance between the outer strut (5) and the inner strut (6) by tightening the transversal bolt (8) loosely in the outer strut and securely in the inner bolt.

Meanwhile, though an adhesive can be applied to the gap between outer/inner packings (5*a*)(5*b*)(6*a*)(6*b*) in the outer/inner struts, transparent or glass panels (11)(11') are inserted between outer/inner struts to block outdoor/indoor air, particularly any inflow of outside temperature, moisture, rainwater and the like, and further keep a vacuum between the upper/lower glass panels (11) against the axial pillar (10).

Also, even though no adhesive is used to keep a vacuum between the upper/lower glass panels (11) when transparent or glass panels (11)(11') are inserted between outer/inner struts (5)(6), outer/inner packings (5*a*)(5*b*)(6*a*)(6*b*) with themselves being inserted into outer/inner packing insertion mounts (5')(5")(6')(6"), are inserted between outer/inner struts to have a strong elastic force and a strong absorbent force. Therefore, even though only the transparent or glass panels (11)(11') are inserted between outer/inner struts, they get to have water-proof, sound-proof, moisture-proof and further impact cushioning effects.

Each outer strut (5), a component forming the strut assembly set (A), has a pair of protruded prop plates (5*c*) under its mid part and a formed groove (5*e*) therein into which each packing insertion mount (5')(5") is inserted respectively from its both ends, and each outer strut (5) is assembled by inserting the insertion mount (5')(5") having the inserted outer packing (5*a*)(5*b*) into the groove (5*e*);

Though only outer/inner packings (5*a*)(5*b*)(6*a*)(6*b*) without packing insertion mounts (5')(5")(6')(6") can have the said effects, it would be more advantageous to use packing insertion mounts (5')(5")(6')(6") in the aspect of long-term durability.

Each outer strut (5) and each inner strut (6) are separately manufactured (see FIG. 6) and fabricated as illustrated in FIG. 9 and FIG. 12. Then, each fixing bolt (9) is vertically inserted through the head opening (8') of the transversal bolt (8), which is inserted and tightened into the bolt opening (7') of the transversal beam of each inner strut (6), and further into the bolt opening (10') of the axial pillar (10) to fix it.

Upper/lower cover plates (12)(12') (see FIG. 9, FIG. 14, FIG. 20, FIG. 21) for upper/lower fastening parts of the axial pillar are fixed onto upper/lower ends of the axial pillar (10) by inserting and tightening upper/lower fixing bolts (9')(9") into the central bolt opening of the axial pillar (10), wherein upper/lower strut assembly sets (A), which are respectively assembled with outer/inner struts (5)(6), are oppositely fastened and assembled to the axial pillar (10). Thereby, pentagonal/hexagonal assembly hubs are completely assembled respectively, as illustrated in FIG. 14. Such assembly hubs are continuously interconnected to form the pentagonal modular assembly (2) as shown in FIG. 1. Then 6 pentagonal modular assemblies (2) are interconnected to build a semi-spherical pre-fabricated dome solidly.

When the prop plate (5*c*) of the outer strut (5) is inserted and assembled between inner prop plates (7')(7") protruded on the inner strut (6), and transparent or glass panels (11)(11') are inserted and installed between outer/inner packings (5*a*)(5*b*)(6*a*)(6*b*), the curved surface, which is holding the outer packings (5*a*)(5*b*) and the inner packings (6*a*)(6*b*), supports the curved surface pivot so that it may adjust the angle of each glass panel (11)(11').

Each outer strut (5), a component forming the semi-spherical pre-fabricated dome according to the present invention, has a pair of protruded prop plates (5*c*) under its mid part and a formed groove (5*e*) in both sides into which each packing insertion mount (5')(5"), into which each outer packing(5*a*)(5*b*) is inserted, is inserted, and each packing insertion mount (5')(5"), into which each inner packing(6*a*)(6*b*) is inserted, is inserted into each groove (6*c*) formed in both sides. And the transversal beam (7) with the bolt opening (7') formed on its bottom is also formed. Thereby, the strut assembly set (A) is formed.

FIG. 9, FIG. 12 and FIG. 18 are characterized in the fact that 4 strut assembly sets (A) are assembled by inserting and tightening the transversal bolt (8) with the head opening (8') into the bolt opening (7') of the transversal beam (7) at the upper end of the axial pillar (10), and the fixing bolt (9) is manually inserted through the head opening (8') and it is tightened and assembled into the bold opening (10'), and the fixing bolt (9) is inserted through the head opening (8') of the transversal bolt (8) coupled with the strut assembly set (A) at the lower end of the axial pillar (10) too so that it may be oppositely and vertically aligned with the bolt opening (10') of the axial pillar (10), and thereby the strut assembly set (A) is tightened, fastened and assembled to the axial pillar;

Each transparent or glass panel (11)(11') is inserted between the outer strut (5) and the inner strut (6), upper/lower packing insertion mounts (5')(5")(6')(6"), into which upper/lower packings (5*a*)(5*b*)(6*a*)(6*b*) are inserted, are inserted into each groove (5*e*) (6*c*) of outer/inner struts.

The outer strut (5) and the inner strut (6) are formed separately, wherein the central prop plates (5*c*) protruded on the outer strut (5) are inserted between the inner prop plates protruded on the inner strut, and the insertion depth can be adjusted according to the thickness of the glass panel (11)(11'). Each strut assembly set (A), which is shown in FIG. 3, FIG. 4, FIG. 12, FIG. 15 and FIG. 16, can have bevels (5*d*) (6*d*) formed on both edges of each of outer/inner struts so that it may be easily connected with the upper end of the axial pillar (10) as illustrated in FIG. 12, or it can have a straight line of the connection surface of each of outer/inner struts, or it can be formed so that it may be easily connected with the side of the axial pillar (10). This formation is applied to one embodiment of assembling 4 strut assembly sets (A) with the axial pillar (10) with 5 bolt openings in the X-shape. Even though it has no bevel formed on both edges of each of outer/inner struts, it can be well assembled with the axial pillar.

That is to say, 4 strut assembly sets can be assembled in the X-shape as illustrated in FIG. 18, wherein they are engaged, assembled and fastened with the axial pillar, and the cover plate (12) for the fastening part is fixed by inserting and tightening the vertical fixing bolts (9')(9") in the central opening of the axial pillar (10) to prevent the outer strut (5) from being separated or removed from the inner strut assembled with the outer strut.

In the semi-spherical dome according to the present invention, outer/inner struts (5)(6) are respectively assembled to the axial pillar (10) by tightening transversal/fixing bolts (8)(9) respectively, and pentagonal/hexagonal assembly hubs (C)(B) are respectively assembled, as shown in FIG. 1. Such assembly hubs are continuously interconnected to form the pentagonal modular assembly (2) in 2 layers. Then 6 pentagonal modular assemblies (2) are interconnected to build a semi-spherical pre-fabricated dome solidly.

On the dome bottom, a dome support (3) is provided as a circumferential sill for the dome building and a gate (3') is installed at the time of assembling the dome building. Such completed dome house provides a underlying solution to the problem involved in the inefficient and uneconomical conventional method to build common houses using building materials, such as sand, aggregates, water, cement, steel bars, lumbers, etc., for a long term with endurance of changes in climate and seasons. The semi-spherical dome, which has used transparent panels to assemble the semi-spherical structure in dual layers, provides benefits to create more pleasant interior environment and reduce the heating cost in the winter.

In addition, if 12 sets of pentagonal modular assemblies are assembled, a cylindrical structure can be built, wherein if the length of the outer strut (5) is 10, the length of the inner strut (6) should be 9, shorter than that of the outer strut. The absorbent force and the elastic force of the packings inserted between outer/inner struts makes the glass panel, which lands on both sides of the strut, seating tightly and solidly between the $1^{st}$ strut and the $2^{nd}$ strut, regardless of the size of the cylindrical shape, because such insertion of transparent or glass panels (11)(11') between outer/inner struts makes 30° inward and downward, and further the sum of each 30° be 60°.

When strut assembly sets (A) are interconnected, outer struts (5) are interconnected as long as the circle size, and inner struts (6) are interconnected shorter than outer struts. So, while strut assembly sets are repetitively interconnects to form a circle, each length of outer/inner struts 95)(6) should be kept strictly.

The first rule to follow in the process to assemble the spherical structure (cylindrical form) is that the assembly set should be a regular hexagon. When 5 regular hexagonal assembly sets are assembled into a pentagonal modular assembly, if 6 sides of the regular hexagonal assembly set are just assembled while outer/inner struts (5)(6) are connected with the axial pillar (10) at a given angle to make a cylindrical form, any circular form is not made. However, if hexagonal assembly sets are connected with the X-shape axial pillar (see FIG. 18), a vertical cylindrical form, where 6 sides and a triangle are intersected, can be assembled and built.

When 6 triangles are assembled, the internal angles make 6 sides, not a cylindrical form. When 6 regular triangles are assembled, a hexagon gets to be made. However, when 5 hexagons are put together, the central angle gets to be a pentagonal angle, and the internal angle of the hexagon is 60°. Since the pentagon's inside is 108°, 6 triangles should be put together in order for hexagons to be assembled to one hexagon. And internal angles of one triangle should be increased to 60° angle X 12 angles in order to make a pentagon. However, since the sum of the internal angles in the regular triangle is 180°, an error takes place in the assembly process to cause some warpage.

In this process, the interval between the axial pillar (10) and the strut assembly set (A) might be decreased or increased. This is because while the sum of internal angles in a hexagon is 720° in the process of assembling 5 hexagons, the sum of internal angles in a pentagon gets to be 540° to cause a serious variable in both the distances and the angle. When outer/inner struts (5)(6) are connected between one axial pillar (10) and another axial pillar, a curved surface (an angle at which the glass panel gets to be inclined) gets to be made. Accordingly, glass panels should make a curved surface on the straight line formed by strut assembly sets. Thus, if the bolt for the strut assembly set (A), which is connected and assembled with the axial pillar (10), fails to be contracted, the strut assembly set cannot be fixed to the axial pillar.

One of key advantages of the present invention is that the tightness of the bolt for the strut assembly set (A) can be contracted to enable the landing surface of the glass panel to roll upward and downward.

Particularly, the present invention has many advantages that there is no need to install a plural number of pillars indoors, a demerit in construction of common buildings, so that space can be used at maximum in the dome house, and its solidness is ensured without installation of any pillar, and modular assemblies suitable for a building structure are pre-fabricated at a factory to be only assembled on site so that the work period and the work cost get to be shortened and reduced, and a semi-spherical pre-fabricated dome house, which has various advantages of solid section performance, strong fire-resistance, high durability, strong corrosion-resistance and strong earthquake-resistance, as well as perfect shock-proof, thermal insulation, sound-proof, which is ensured by forming transparent/glass panels (11)(11') in dual layers to keep a vacuum state, is characteristically provided.

In an aspect of the invention, 12 pentagonal modular assemblies (2) are assembled to form a pre-fabricated spherical structure on a tubular support.

So, in an example of a pre-fabricated semi-spherical dome and a spherical structure which are formed in combination of pentagons and hexagons of the invention:

the semi-spherical dome is built by assembling 6 sets of pentagonal modular assemblies (2), each of which is a structure assembled by coupling 6 outer/inner struts (5)(6) with a hexagonal assembly hub (B), and 5 outer/inner struts (5)(6) with a pentagonal assembly hub (C) in 2 layers, wherein each strut has bevels (5*d*) (6*d*) on its both edges, and the outer/inner struts (5)(6) are of the same form except a transversal beam (7), and particularly the strut assembly set (A) is fixed by fastening it to the axial pillar (10) by tightening upper/lower fixing bolts (9')(9") inserted through the bolt opening (10') of the axial pillar (10) and then covering the upper/lower fastening parts of the axial pillar with a cover plate (12) and a packing (12*a*);

each outer strut (5), a component forming the strut assembly set (A), has a pair of protruded prop plates (5*c*) beneath its mid part and a groove (5*e*) formed between them, into which each of packing insertion mounts (5')(5") is inserted from its both ends, and each outer strut (5) is formed by inserting each of packing insertion mounts (5')(5") having the inserted outer packings (5*a*)(5*b*) into the groove (5*e*);

each inner strut (6), which is coupled with the lower part of the strut assembly set, has also a pair of inner prop plates (7") protruded on its mid part and a groove (6*c*) formed between them, which receives the prop plate (5*c*), into which each of packing insertion mounts (6')(6") is inserted in its both sides, and each inner strut is assembled by inserting each of packing insertion mounts (6')(6") having the inserted inner packing (6*a*)(6*b*) into the groove (6*c*), having the transversal beam (7) with the bolt opening (7') and the bump insertion port (7*a*) formed beneath it;

each of transparent panels or glass panels (11)(11') is inserted between packings (5*a*)(5*b*) (6*a*)(6*b*) of outer/inner struts, and thereby the packing, which is highly elastic and cushioned, responds to the thickness of the glass panel, and the transparent or glass panel (11)(11') is assembled so that its angle may be adjusted upward or downward to have water-proof, sound-proof, moisture-proof and impact cushioning effects;

a plural number of strut assembly sets (A) are assembled by inserting and tightening the transversal bolt (8) with the bolt bump (8'') and the head opening (8') into the bolt opening (7') of the transversal beam (7) respectively at the upper end of the axial pillar (10), and the fixing bolt (9) is manually inserted through the head opening (8') and it is tightened and assembled into the bolt opening (10'), and the fixing bolt (9) is inserted through the head opening (8') of the transversal bolt (8) coupled with the strut assembly set (A) at the lower end of the axial pillar (10) so that it may be oppositely and vertically aligned with the bolt opening (10') of the axial pillar (10), and thereby the strut assembly set (A) is tightened, fastened and assembled to the axial pillar;

upper/lower strut assembly sets (A) are oppositely fastened and assembled to upper/lower ends of the axial pillar (10) in 2 layers by tightening the transversal bolt (8) and the fixing bolt (9), respectively;

a cylindrical structure is formed by assembling 12 sets of pentagonal assemblies (2); and each strut assembly set (A) is lengthwise (interval-wise) adjusted by tightening its transversal bolt (8) loosely or securely into its bolt opening (7'), and the glass landing surface is variably rolled according to its upward or downward changeable angle.

The invention claimed is:

1. A pre-fabricated semi-spherical dome formed of structures in shapes of pentagons and hexagons;

wherein the semi-spherical dome is built by assembling six pentagonal modular assemblies, each of which comprises six outer and inner struts which comprise a hexagonal assembly hub, and five outer and inner struts which comprise a pentagonal assembly hub, in two layers, wherein each strut has two bevels on an end thereof, and the inner struts each comprise a transversal beam, and the inner struts and the outer struts are assembled into at least one strut assembly set, and the strut assembly set is fastened to a respective axial pillar, and wherein upper and lower fastening parts of the axial pillar are covered with a cover plate and a packing, respectively, by tightening upper and lower first fixing bolts inserted through a first bolt opening in the axial pillar, and wherein inner packing insertion mounts are inserted into inner strut grooves in struts of the hexagonal and pentagonal assembly hubs, and wherein a lower part of the strut assembly set is assembled by inserting the inner packing insertion mounts having the inserted inner packings into the inner strut grooves, and each transversal beam has a bolt opening and a bump insertion port formed therein, and the transversal beam is positioned beneath a respective inner strut.

2. The pre-fabricated semi-spherical dome according to claim 1, wherein each outer strut has a pair of protruded prop plates beneath its mid part and an outer strut groove, wherein outer packing insertion mounts are inserted into respective outer strut grooves and each outer strut is formed by inserting the outer packing insertion mounts having inserted outer packings into the outer strut grooves; and wherein each inner strut is comprised in a lower part of the strut assembly set, and has a pair of inner prop plates protruded on its mid part and a middle inner strut groove formed between the inner prop plates, which receives the protruded prop plates, and wherein the inner packing insertion mounts are inserted proximate to sides of the middle inner strut groove.

3. The pre-fabricated semi-spherical dome according to claim 1, wherein transparent panels or glass panels are inserted between the inner packings of inner struts and outer packings of outer struts, and wherein the inner and outer packings are elastic and cushioned, and respond to the thickness of the transparent panels or glass panels, and the transparent panels or glass panels are configured to have an adjustable upward or downward orientation to have water-proof, sound-proof, moisture-proof and impact cushioning effects.

4. The pre-fabricated semi-spherical dome according to claim 1, wherein a plurality of strut assembly sets are assembled by inserting and tightening a transversal bolt having a bolt bump and a head opening into the bolt opening of the transversal beam at an upper end of the axial pillar, and a second fixing bolt is inserted through the head opening and is tightened and assembled into a second bolt opening of the axial pillar, and a third fixing bolt is inserted through a head opening of a second transversal bolt coupled with the strut assembly set at a lower end of the axial pillar, wherein the third fixing bolt is oppositely and vertically aligned with the second bolt opening of the axial pillar, and thereby another strut assembly set is tightened, fastened and assembled to the axial pillar.

5. The pre-fabricated semi-spherical dome according to claim 4, wherein each strut assembly set is adjusted along its length by tightening a corresponding transversal bolt loosely or securely into a corresponding bolt opening, and a glass panel is operably connected to the corresponding transversal bolt and is movable to have different orientations.

6. The pre-fabricated semi-spherical dome according to claim 4, wherein the bolt bump, which protrudes on the tip of the head opening, is inserted into a blot bump insertion port formed in one of the bolt openings of the axial pillar to prevent wobbling.

7. The pre-fabricated semi-spherical dome according to claim 1, wherein upper and lower strut assembly sets are oppositely fastened and assembled to respective upper and lower ends of the axial pillar in two layers by tightening respective transversal bolts and fixing bolts.

8. The pre-fabricated semi-spherical dome according to claim 1, wherein one pentagonal assembly hub and five hexagonal assembly hubs are assembled to form each pentagonal modular assembly.

* * * * *